US006752706B1

(12) United States Patent
Chuang

(10) Patent No.: US 6,752,706 B1
(45) Date of Patent: Jun. 22, 2004

(54) ADJUSTING DEVICE FOR THE SANDING DRUM OF A DOUBLE-DRUM SANDER

(76) Inventor: Po Chang Chuang, No. 222, Tsung-Yi 6th St., Taiping City (TW)

( * ) Notice: Subject to any disclaimer, the term of this patent is extended or adjusted under 35 U.S.C. 154(b) by 0 days.

(21) Appl. No.: 10/453,626

(22) Filed: Jun. 4, 2003

(51) Int. Cl.[7] ..... B24B 21/00

(52) U.S. Cl. ..... 451/311; 451/296; 451/299; 451/300; 451/301; 451/302

(58) Field of Search ..... 451/296, 299, 451/300, 301, 302, 311

(56) References Cited

U.S. PATENT DOCUMENTS 4,720,940 A * 1/1988 Green ..... 451/340
5,341,605 A * 8/1994 Tasikas ..... 451/350
5,842,913 A * 12/1998 Nemazi ..... 451/499

* cited by examiner

*Primary Examiner*—Joseph J. Hail, III
*Assistant Examiner*—Shantese McDonald
(74) *Attorney, Agent, or Firm*—Troxell Law Office PLLC

(57) ABSTRACT

An adjusting device for the sanding drum of a double-drum sander is installed between the opposite ends of the rear grinding drum and the machine frame of a sander for adjusting a rear sanding drum to a most suitable height to match with the size number of the emery of the front sanding drum of the sander so as to carry out abrading with excellent effect.

5 Claims, 6 Drawing Sheets

ADJUSTING DEVICE FOR THE SANDING DRUM OF A DOUBLE-DRUM SANDER

BACKGROUND OF THE INVENTION

1. Field of the Invention

This invention relates to an adjusting device for the sanding drum of a double-drum sander, particularly to one able to micro-adjust the rear sanding drum of a sander to move up and down to match with the size number of the emery of the front sanding drum of the sander for carrying out abrading with precision.

2. Description of the Prior Art

A conventional double-drum sander 10, as shown in FIG. 1, includes a machine frame 11, two sanding drums 12, 13 respectively installed at the front and the rear section of the machine frame 11 and a conveyer 14 located under the two grinding drums 12, 13. Generally, the two sanding drums 12, 13 have their surfaces respectively provided with coarse and fine emery to abrade an article orderly so as to achieve excellent effect of abrading of the article. Besides, to deal with articles of different thickness and control the abrading thickness of an article, the machine frame 11 of the sander 10 is provided with a hand crank 15 and a helical rod 16 connected together to be turned for adjusting the conveyer 14 to move up and down and controlling the article thereon to touch with the two sanding drums 12, 13 to an anticipated extent.

However, the two sanding drums 12, 13 of the conventional sander 10 are axially and fixedly assembled with the bearing 17 of the machine frame 11. Thus, when the axles of the two sanding drums 12, 13 are positioned at a same height, the rear sanding drum 13, which has its surface provided with fine emery and which is impossible to be adjusted to move up and down, can hardly obtain good effect of abrading of an article. If the two sanding drums 12, 13 are positioned with a fixed distance difference between them, the size of the emery provided on the rear sanding drum 13 still has to be changed in order to match with material of the article to be abraded or meet different requirements of the precision of abrading, equally failing to achieve excellent effect of abrading.

SUMMARY OF THE INVENTION

The objective of this invention is to offer an adjusting device for the sanding drum of a double-drum sander, which is provided between the opposite ends of the rear sanding drum and the machine frame of a sander for micro-adjusting the rear sanding drum to move up and down. The adjusting device has indicating graduations marked thereon, so that the rear sanding drum can be precisely adjusted to a most suitable height to match with the size number of the emery provided on the front sanding drum of the sander and carry out abrading with precision.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
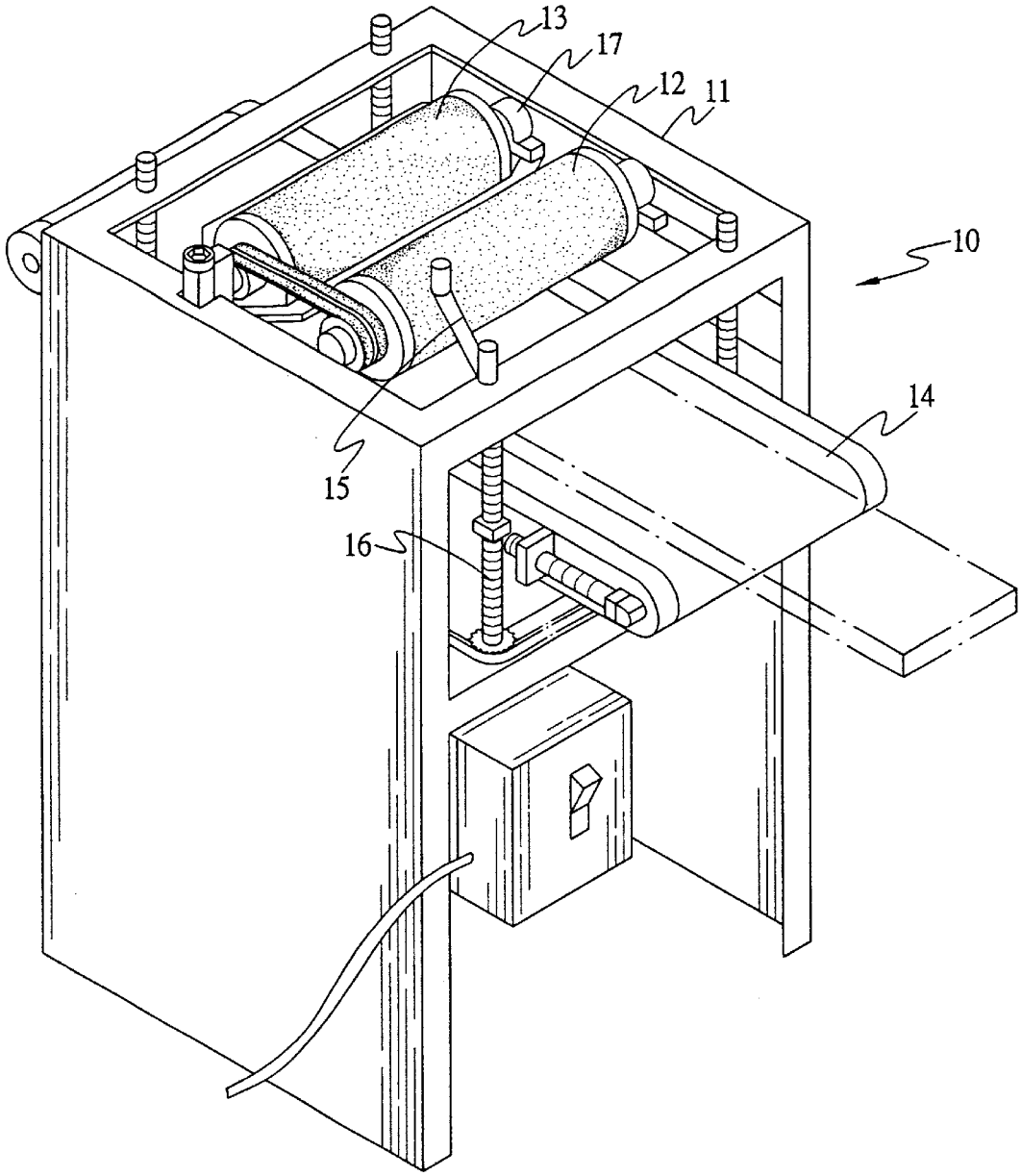
FIG. 1 PRIOR ART
FIG. 1 is a perspective view of a conventional sander.
Figure 2:
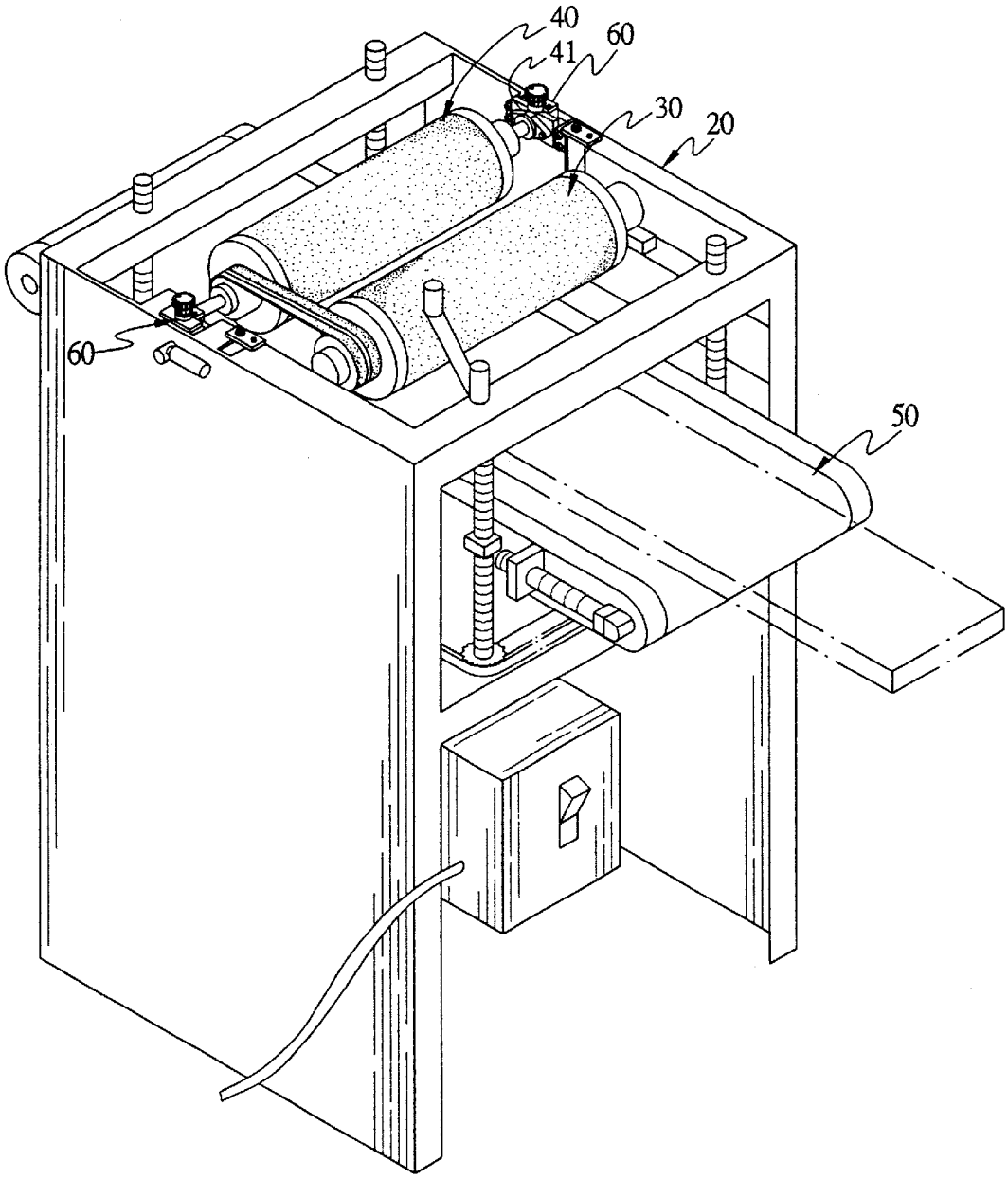
FIG. 2 is a perspective view of a double-drum sander in the present invention.
Figure 3:
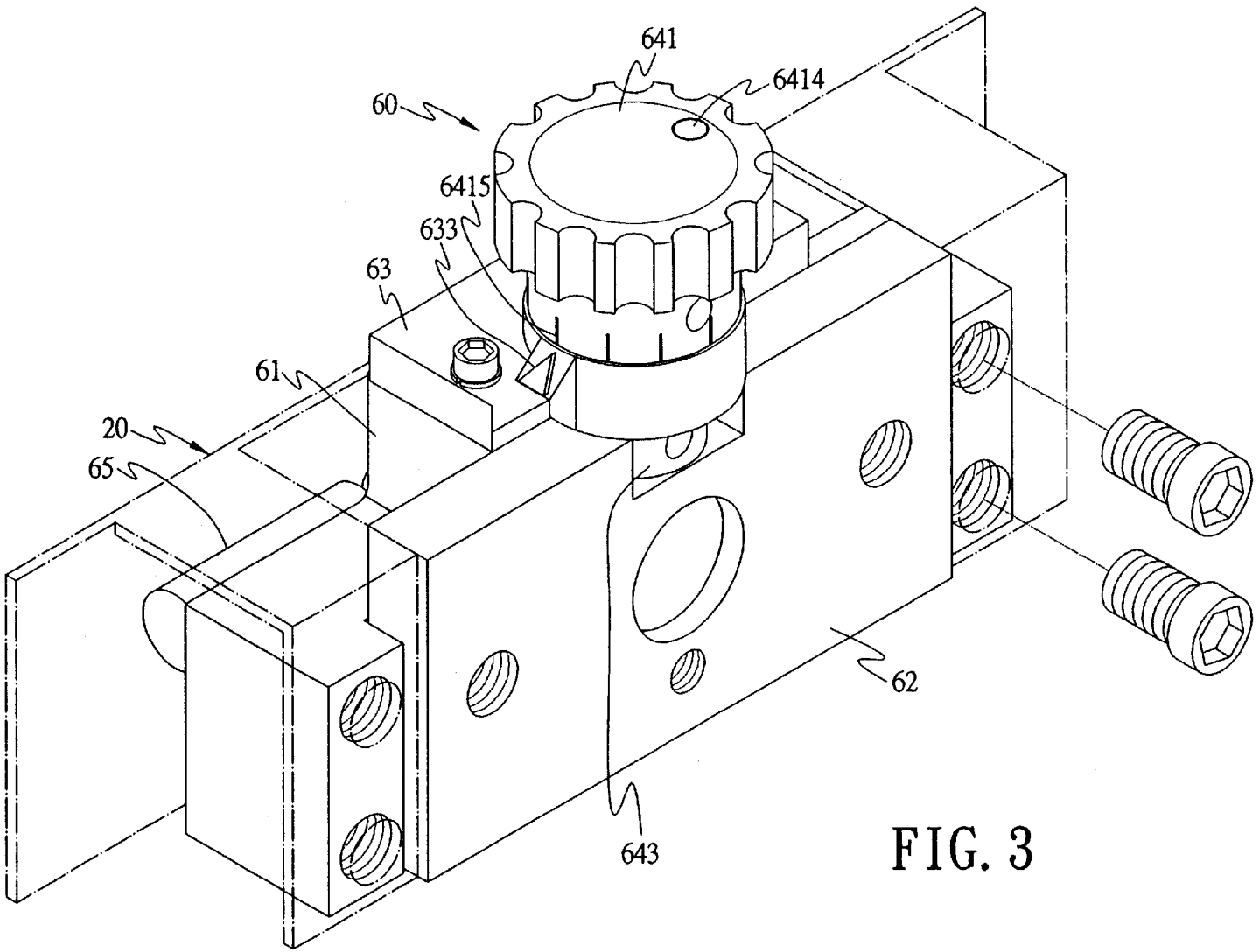
FIG. 3 is a perspective view of an adjusting device for the sanding drum of the double-drum sander in the present invention.
Figure 4:
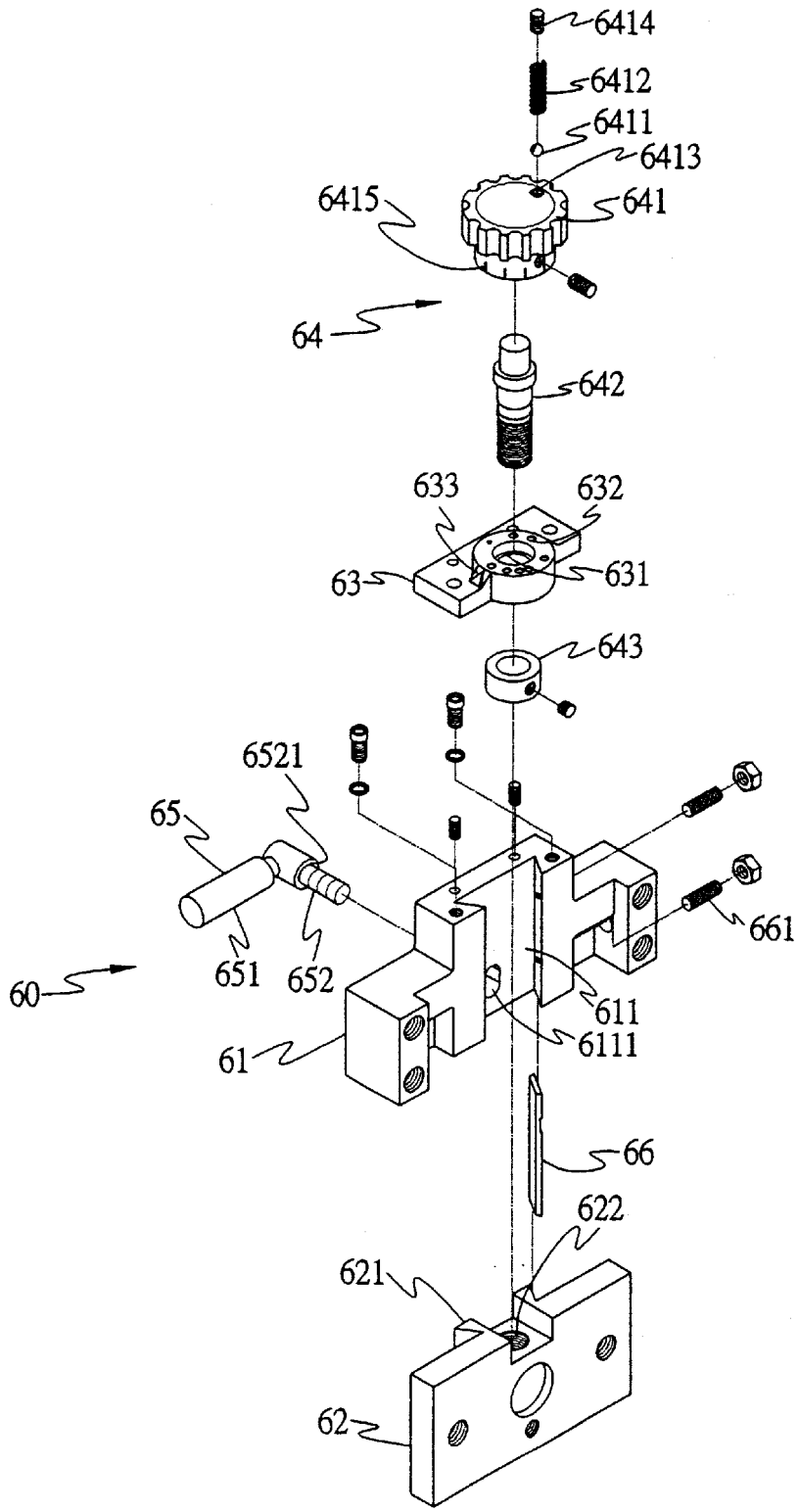
FIG. 4 is an exploded perspective view of the adjusting device for the sanding drum of the double-drum sander in the present invention.

A preferred embodiment of a double-drum sander in the present invention, as shown in FIG. 2, includes a machine frame 20, two sanding drums 30, 40, a conveyer 50 and two adjusting devices 60 combined together. The two sanding drums 30, 40 are respectively installed at the front and the rear section of the machine frame 20, and the conveyer 50 is positioned under the two sanding drums 30, 40 for carrying an article and moving it under the two sanding drums 30, 40 to be abraded. The adjusting device 60 is installed between the opposite ends of the rear sanding drum 40 and the inner wall of the machine frame 20 by means of a bearing base 41. The adjusting device, as shown in FIGS. 3 and 4, is composed of a fundamental base 61, a slide base 62, a shaft base 63, a rotary adjuster 64 and a locking handle 65 combined together.

The fundamental base 61 is fixedly assembled on the inner wall of the mach in e frame 20 facing the opposite ends of the rear sanding drum 40. The fundamental base 61 has its inner wall formed with a dovetail-shaped groove 611 having a perpendicular insert slot 6111 bored at a proper location.

The slide base 62 is a flat plate, having one side fixed with the bearing base 41 and the other side formed with a dovetail-shaped block 621 to be fitted in the dove tail-shaped groove 611 of the fundamental base 61. The slide base 62 is further provided with a threaded hole 622 in the upper central edge.

The shaft base 63 to be fixedly assembled on the fundamental base 61 is bored in the center with a vertical insert hole 631 having its upper circumferential edge formed with a plurality of bead recesses 632.

The rotary adjuster 64 is composed of a rotary button 641, a threaded rod 642 and a position-limiting toggle 643. The threaded rod 642 is inserted in the insert hole 631 of the shaft base 63. The rotary button 641 and the position-limiting toggle 643 are respectively fitted around the upper and the lower end of the threaded rod 642, with the position-limiting toggle 643 received in the lower section of the insert hole 63 1 of the shaft base 63, letting the helical rod 642 able to rotate pivotally on the shaft base 63. Besides, the threaded rod 642 has its lower end threadably combined with the threaded hole 622 of the slide base 62. Thus, when the rotary button 641 is turned around, the threaded rod 462 will be actuated to rotate and make the slide base 62 and the bearing base 41 move up and down together with the rear sanding drum 40, which has its opposite ends axially fitted with the bearing base 41.

In addition, the rotary button 641 is bored at a proper location of its upper edge with a through hole 6413 having a fitting bead 6411 and a spring 6412 orderly received therein. A tightening bolt 6414 is threadably provided at the upper end of the through hole 6413 to compress the spring 6412 to push against the fitting bead 6411. The through hole 6413 has its lower end formed with an opening with a comparatively small diameter so as to let the fitting bead 6411 slightly protrude out of the opening and exactly positioned in any of the bead recesses 632 at the upper edge of the shaft base 63. Further, the rotary button 641 and the shaft base 63 respectively have their outer circumferential wall marked with indicating graduations 6415, 633; therefore the rotary button 641 is able to precisely adjust the rear grinding drum 40 to a most suitable height for carrying out abrading in accordance with the indicating graduations.

Figure 5:
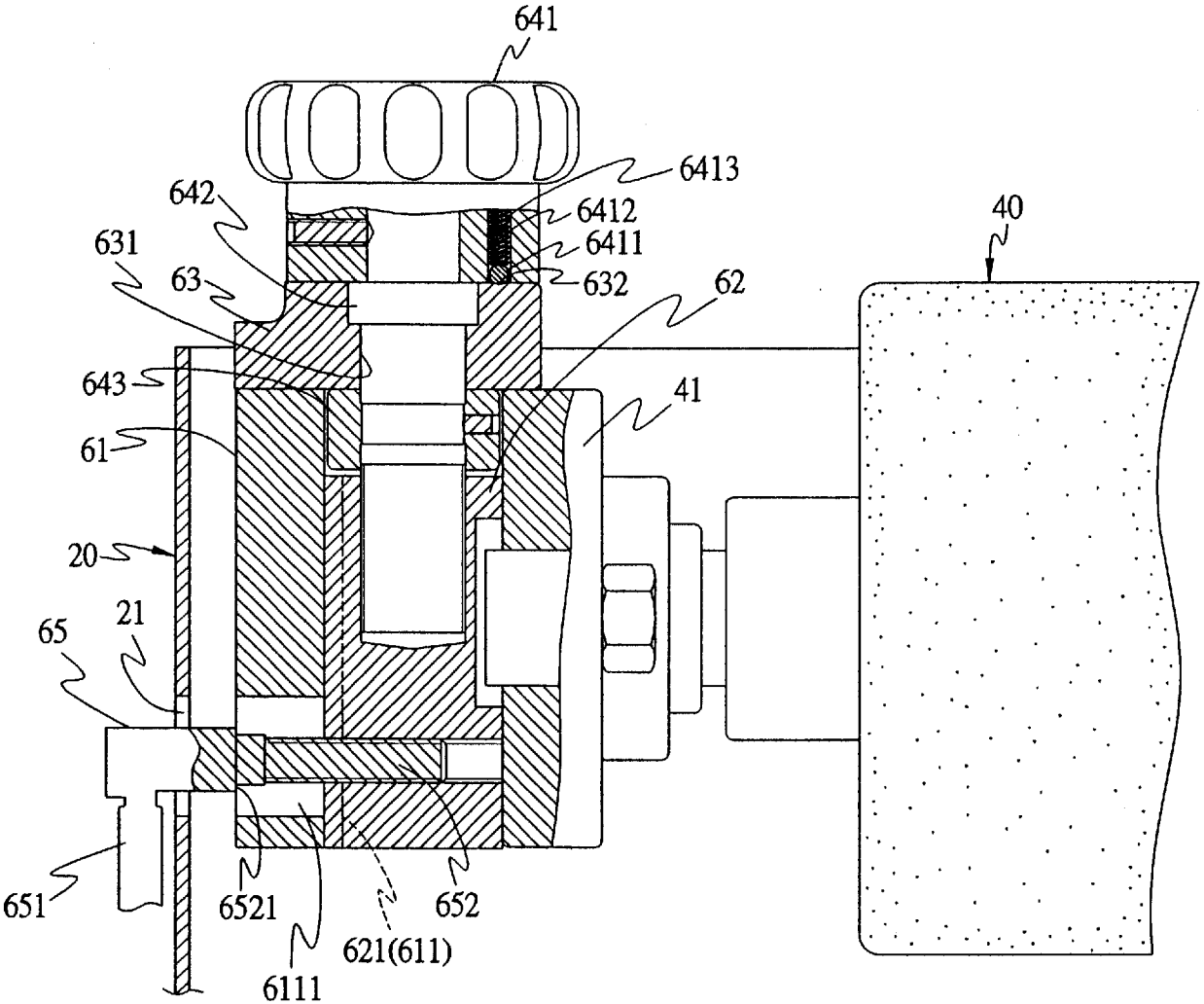
FIG. 5 is a cross-sectional view of the adjusting device for the sanding drum of the double-drum sander in the present invention.

The locking handle 65, as shown in FIG. 5, is composed of a handle 651 and a bolt 652. The bolt 652 is inserted through a lateral through groove 21 bored in the outer wall of the machine frame 20 and also through the insert slot 6111 of the fundamental base 61 and then threadably assembled on the outer wall of the slide base 62. Besides, the bolt 652 has its upper end formed with a head 6521 to push against the outer wall of the fundamental base 61. Thus, when the locking handle 65 is turned tight, the slide base 62 and the fundamental base 61 will push tightly against each other and hence the slide base 62 will be fixed in position after adjusted.

Furthermore, a tightening gasket 66 is disposed between a sidewall of the dovetail-shaped groove 611 of the fundamental base 61 and the dovetail-shaped block 621 of the slide base 62, and fastened on the sidewall of the dovetail-shaped groove 611 by a locking bolt 661.

After fitted together, the fundamental base 61 and the slide base 62 can be adjusted to a most suitable and smooth sliding condition by means of the locking bolt 661, which can be adjusted to actuate the tightening gasket 66 to push against the slide base 62.

Figure 6:
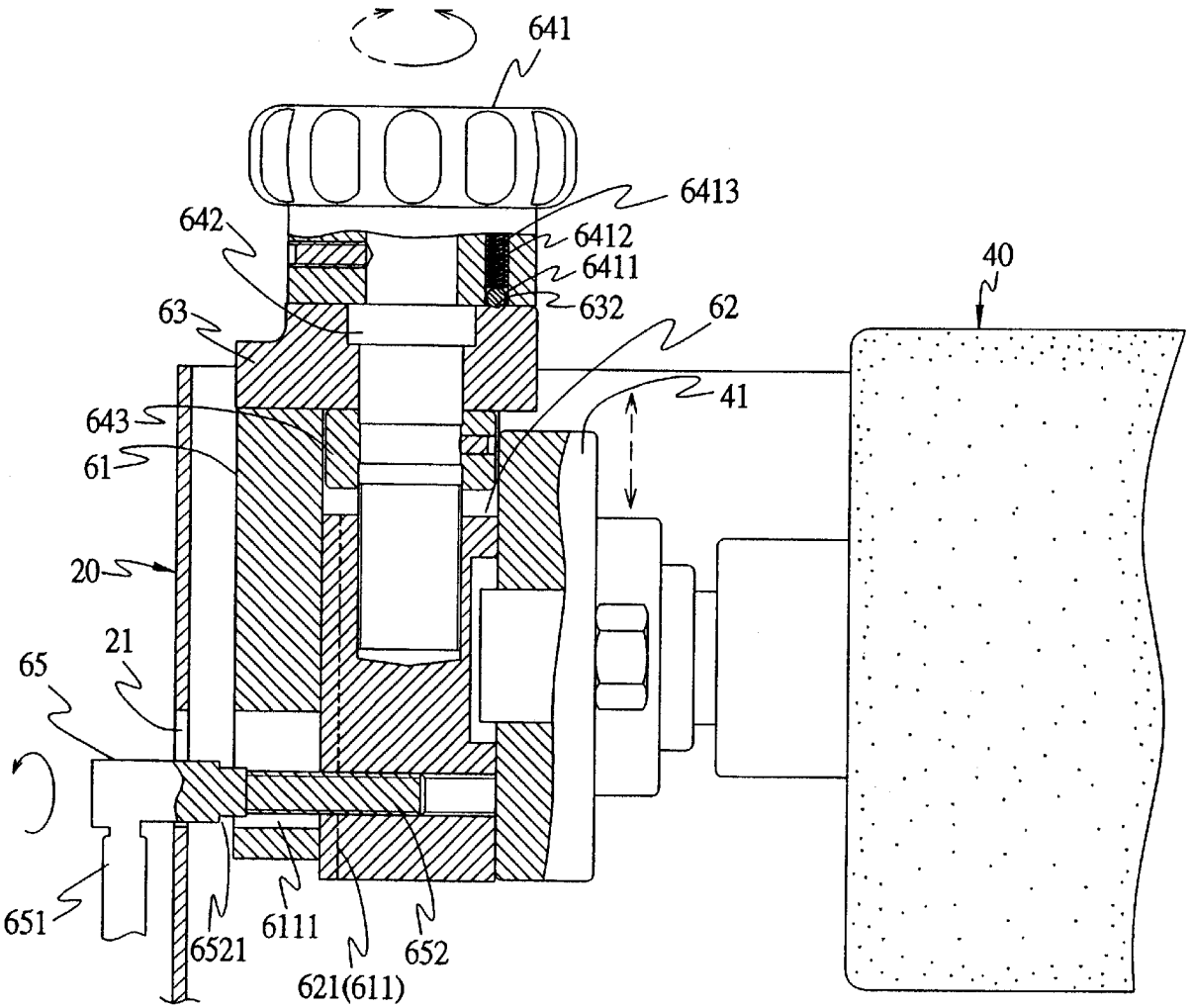
FIG. 6 is a cross-sectional view of the adjusting device in a condition of adjusting the rear sanding drum of the double-drum sander in the present invention.

To adjust the height of the rear sanding drum 40, as shown in FIG. 6, firstly, release the locking handle 65 of the adjusting device 60 to loosen the slide base 62 and the fundamental base 61 into a movable condition. Next, based on the size number of the emery of the front and the rear sanding drum 30, 40 and matching with the indicating graduations 6415, 633 of the rotary button 641 and the shaft base 63, the rotary button 641 is turned and positioned at a preset indicating graduation, and then the locking handle 65 is turned tight to make the slide base 62 positioned firmly on the fundamental base 61. Simultaneously, the shaft base 41 is secured on the slide base 62, and the rear sanding drum 40 are moved and positioned at a most suitable height to match with the front sanding drum 30, thus able to carry out abrading with excellent effect.

While the preferred embodiment of the invention has been described above, it will be recognized and understood that various modifications may be made therein and the appended claims are intended to cover all such modifications that may fall within the spirit and scope of the invention.

I claim:

1. An adjusting device for the sanding drum of a double-drum sander respectively installed between opposite ends of a rear sanding drum and a machine frame of a sander, said adjusting device comprising:

a fundamental base secured on an inner wall of said machine frame facing the opposite ends of said rear sanding drum, said fundamental base having an inner wall formed with a dovetail-shaped groove, said dovetail-shaped groove provided with a perpendicular insert slot;

a slide base having a first side combined with said rear sanding drum and a second side formed with a dovetail-shaped block, said dovetail-shaped block fitted with said dovetail-shaped groove, said slide base further bored with a threaded hole in an upper central edge;

a shaft base fixedly assembled on a topside of said fundamental base, said shaft base formed with a vertical insert hole in the center;

a rotary adjuster composed of a rotary button, a threaded rod and a position-limiting toggle, a helical rod inserted in said insert hole of said shaft base, said rotary button and said position-limiting toggle respectively fitted on an upper and a lower end of said threaded rod, said position-limiting toggle received in a lower end of said insert hole of said shaft base, said threaded rod able to rotate pivotally on said shaft base, said threaded rod having its lower end threadably combined with said threaded hole at the topside of said slide base, said rotary button able to control said threaded rod to move up and down together with said slide base and said rear sanding drum which is combined with said slide base; and a locking handle consisting of a handle and a bolt, said bolt inserted through the wall of said machine frame from outside, said bolt then passing through said insert slot of said fundamental base and fixed with said slide base, said lock handle turned tight to fix said slide base in position on said fundamental base after adjusted.

2. The adjusting device for the sanding drum of a double-drum sander as claimed in claim 1, wherein said rear sanding drum has its opposite ends respectively fitted with a bearing base which is to be fixed with said slide base.

3. The adjusting device for the sanding drum of a double-drum sander as claimed in claim 1, wherein said insert hole of said shaft base has its upper circumferential edge formed with a plurality of bead recesses, and said rotary button is bored at a proper location of its top edge with a through hole having a fitting bead and a spring orderly received therein, with a tightening bolt threadably fitted in said through hole to compress said spring to push against said fitting bead, said through hole having its lower end formed with an opening with a comparatively small diameter, letting said fitting bead slightly protrude out of said opening and exactly positioned in any of said bead recesses at the topside of said shaft base, said rotary button and said shaft base respectively having an outer circumferential wall marked with indicating graduations, said rotary button able to precisely micro-adjust said rear sanding drum up and down to a best height of said indicating graduations.

4. The adjusting device for the sanding drum of a double-drum sander as claimed in claim 1, wherein a tightening gasket is provided between a side wall of said dovetail-shaped groove of said fundamental base and of said dovetail-shaped block of said slide base, and said tightening basket is fixed with the side wall of said dovetail-shaped groove by a locking bolt, said locking bolt able to be adjusted to actuate said tightening gasket to push against said slide base after said fundamental base and said slide base are fitted together, said fundamental base and said slide base able to be adjusted to a most suitable and smooth sliding condition.

5. The adjusting device for the sanding drum of a sander as claimed in claim 1, wherein said machine frame is bored with a lateral through groove in the outer wall facing said bolt of said locking handle, and said bolt has its outer end formed with a head, said head of said bolt pushing against the outer wall of said insert slot of said fundamental base when said bolt is inserted through said through groove of said machine frame and through said insert slot of said fundamental base.

* * * * *